US005190019A

United States Patent [19]

Harvey

[11] Patent Number: 5,190,019

[45] Date of Patent: Mar. 2, 1993

[54] INTERLOCK CIRCUIT FOR DE-ACTIVATING AN ENGINE

[75] Inventor: Arthur J. Harvey, Streetsboro, Ohio

[73] Assignee: Delta Systems, Inc., Streetsboro, Ohio

[21] Appl. No.: 757,178

[22] Filed: Sep. 10, 1991

[51] Int. Cl.[5] ..... F02P 11/00

[52] U.S. Cl. ..... 123/630; 123/198 DC

[58] Field of Search ..... 123/630, 198 DC, 397

[56] References Cited

U.S. PATENT DOCUMENTS

| | | | |
|---|---|---|---|
| 3,884,203 | 5/1975 | Cliffgard | 123/198 DC |
| 4,369,745 | 1/1983 | Howard | 123/630 |
| 4,385,617 | 5/1983 | Nakata et al. | 123/602 |
| 4,392,474 | 7/1983 | Minner | 123/630 |
| 4,565,179 | 1/1986 | Nytomt et al. | 123/198 DC |
| 4,594,978 | 6/1986 | Kanno | 123/198 DC |

*Primary Examiner*—Raymond A. Nelli

*Attorney, Agent, or Firm*—Watts, Hoffmann, Fisher & Heinke

[57] ABSTRACT

A safety circuit coupled to an ignition circuit and a magneto coil for disabling an engine that powers a riding lawn mower. The circuit includes a triac which is rendered conductive in response to a sensed unsafe condition. The triac turns on to short the magneto coil and prevent generation of a spark plug energization voltage. A capacitor coupled to the triac gate electrode charges in the event an unsafe condition is sensed and is prevented from charging when operating conditions are safe.

11 Claims, 5 Drawing Sheets

INTERLOCK CIRCUIT FOR DE-ACTIVATING AN ENGINE

FIELD OF THE INVENTION

The present invention concerns a safety control circuit for controlling the operation of a combustion engine having a magneto for energizing a spark plug and more particularly concerns a safety control circuit for use in controlling operation of a riding lawn mower.

BACKGROUND ART

U.S. Pat. No. 4,369,745 to Howard, which issued Jan. 25, 1983, concerns an interlock circuit for a motor vehicle that is powered by an internal combustion engine. The internal combustion engine is coupled to a magneto ignition system and includes circuitry for inhibiting starting of the engine under certain conditions. The interlock circuit is electrically connected to an ignition switch and three safety switches. One safety switch opens when the transmission to a traction drive is engaged, and a second safety switch opens when a power take-off from the engine is engaged. The disclosed and preferred use of the ignition interlock of the '745 patent is with a riding lawn mower having a third safety switch which opens whenever the operator gets off the lawn mower.

The switches prevent operation of the lawn mower solenoid starter in the event an unsafe condition is sensed. The engine is also disabled subsequent to starting of the engine if the seat becomes unoccupied and either the transmission or power take-off is engaged. If both the transmission and power take-off are disengaged, the operator can get off the seat and the engine will continue to run. The disclosure of the '745 patent to Howard is incorporated herein by reference.

FIGS. 1*a* and 1*b* depict prior art safety interlock systems commercially available from the assignee of the present invention. An SCR device coupled to an engine magneto coil short circuits the magneto coil under certain conditions. Once the engine is running, the SCR turns on to deactivate the engine if the seat switch is open and one or both the transmission and power take-off switches are also open. If the seat switch opens and both the transmission and the power take-off switch are closed, the engine continues to run since this switch configuration means both the transmission and power take-off are disengaged and in a safe operating condition.

The circuit depicted in FIG. 1*a* responds to negative pulses from the engine magneto. The circuit depicted in FIG. 1*b* responds to positive pulses from the engine magneto. Thus, two separate circuits, one for the FIG. 1*a* embodiment and the second for the FIG. 1*b* embodiment are required to accomplish the same safety control function for different ignition systems.

Marlin Electric of Milwaukee, Wis. produces a commercially available circuit for disabling an engine. The circuit includes a triac that is activated by a battery voltage which is coupled to a triac control electrode when an unsafe condition is sensed.

DISCLOSURE OF THE INVENTION

The present invention concerns a safety circuit for inhibiting operation of an engine having a spark plug that is energized by a magneto coil. The circuit includes a triac coupled to the magneto coil for shorting the magneto coil and thereby inhibiting engine operation. A circuit coupled to the triac activates the triac with a magneto generated signal at the triac gate when the engine is running and an unsafe condition is sensed. Once the triac is rendered conductive, the engine is quickly disabled. The use of a triac eliminates the requirement for two separate circuits to accomplish the same safety control function for different engine ignition circuits.

A safety circuit constructed in accordance with the present invention also avoids false sensing of an unsafe condition. The safety circuit utilizes switch contacts forming part of an ignition circuit that controls starting of the engine. If moisture condenses on these switch contacts, the engine may continue to run when, in fact, an unsafe condition exists. Use of a safety circuit constructed in accordance with the present invention makes false sensing of a safe condition much less likely.

BEST MODE FOR PRACTICING THE INVENTION

Figure 2:
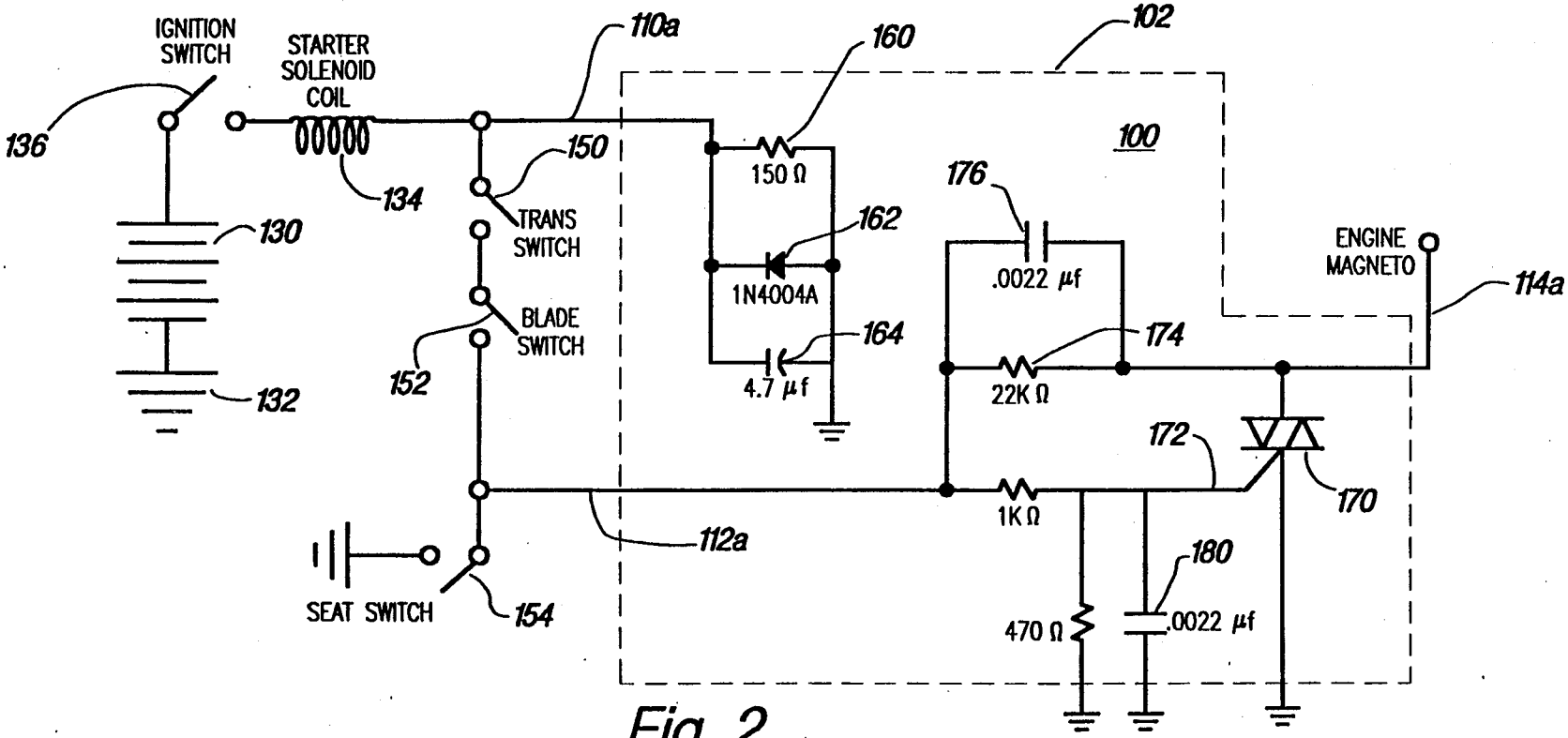
FIG. 2 is a schematic diagram of a circuit constructed in accordance with one embodiment of the invention that disables an engine in response to a sensed condition.
Figure 4:
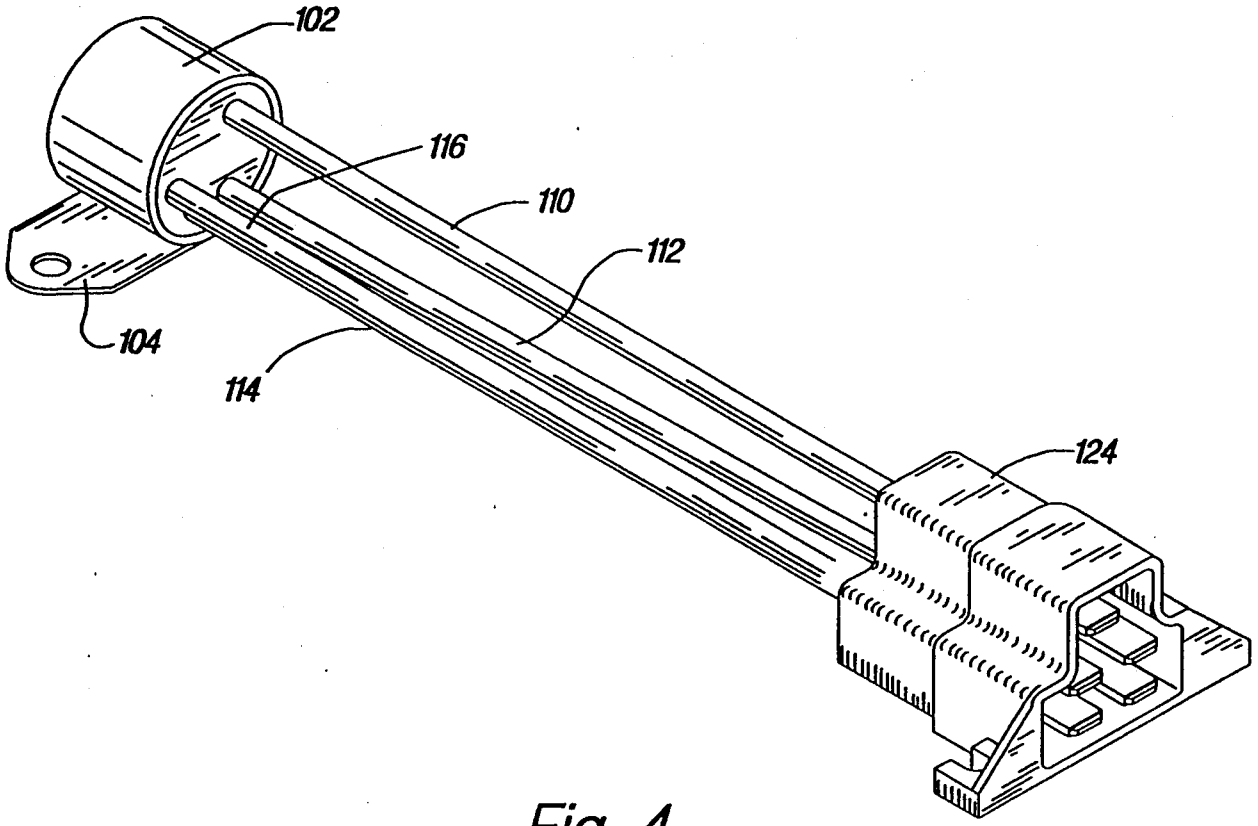
FIG. 4 is a perspective view showing a module for housing the circuits of FIGS. 2 and 3.

FIG. 2 depicts an interlock or safety circuit 100 constructed in accordance with a preferred embodiment of the invention. The circuit 100 is supported within a metal housing 102 (FIG. 4) having an outwardly extending tab 104 which supports the housing. Three insulated wires 110, 112, 114 having conductors 110*a*, 112*a*, 114*a* are connected to the circuit 100 of FIG. 2 and exit a potting material 106 which encases the circuit 100. A fourth wire 116 carries a ground conductor that defines a ground voltage for the FIG. 2 circuit. The wires 110, 112, 114, 116 terminate at a connector 124 having contacts for engagement with a corresponding female connector (not shown). The corresponding female connector is electrically coupled to FIG. 2 circuit components external to the safety circuit 100 such as a starter solenoid, an engine magneto coil, and multiple safety switches described below.

A 12-volt battery 130 having a ground connection 132 energizes a starter solenoid coil 134 when the operator closes an ignition switch 136. Sufficient energization current (3 to 4 amperes) passes through the solenoid coil 134 only if three series-connected safety switches 150, 152, 154 are closed. A first switch 150 is coupled to a traction transmission which causes the wheels of the vehicle to rotate. In the preferred embodiment of the invention, the combustion engine is for a riding lawn mower. The transmission safety switch 150 is closed if the traction drive of the lawn mower is disengaged. A second safety switch 152 is coupled to a power take-off of the engine. This second safety switch 152 is closed if the mower blade is disengaged. The third switch 154 is a seat switch which is closed whenever the seat is occupied and opens in the event the operator leaves the lawn mower seat.

For all these switches 150, 152, 154 to be closed, the operator must be seated on the seat and both the lawn mower transmission and blade are disengaged. In the event any of these switches are open, a low impedance path to ground through these switches from one end of the starter solenoid 134 is removed.

As seen in FIG. 2, the solenoid coil 134 is also coupled to ground through the parallel combination of a resistor 160, diode 162, and capacitor 164 that form part of the safety circuit 100. The resistance 160 is in series with the low (approximately 4 ohm) resistance of the starter solenoid 134. Closure of the ignition switch 136 with one of the switches 150, 152, 154 open will cause current to flow through the series combination of the starter solenoid coil 134 and the resistor 160, but of a magnitude much less than the 3 to 4 amps needed to actuate the starter.

Once the combustion engine is running, the circuit 100 monitors the continued status of the switches 150, 152, 154. In the event an unsafe operating condition is sensed, the engine is deactivated by shorting an engine magneto primary coil thereby inhibiting voltage from reaching the spark plug. Once the magneto primary coil is shorted, the engine stops and cannot be restarted until all three switches 150, 152, 154 are again closed corresponding to a safe condition. One example of an unsafe condition is the situation where the operator leaves the seat of the lawn mower and either the transmission or the power take-off is engaged. If the operator leaves the seat, but both the power take-off and transmission are disengaged, however, the engine continues to run.

The circuit 100 includes a triac 170 coupled in parallel to a primary coil of the engine magneto. The magneto also includes a transformer secondary inductively coupled to the primary that transmits large voltages (approximately 20 kilovolts) to the spark plug each time current through the magneto primary is disrupted. U.S. Pat. No. 4,270,509 to Tharman discloses a typical small engine magneto system for use with a lawn mower and is incorporated herein by reference. If the triac 170 has been rendered conductive, the time varying signal imposed across the primary is shunted to ground through the conducting triac. Without sufficient spark voltage, the spark plug does not ignite combustibles in the combustion chamber and the engine stops.

The triac 170 is rendered conductive whenever the voltage at a control or gate electrode 172 increases to a point where the triac 170 turns on. The gate electrode of the triac 170 can be activated with either a positive or negative voltage with respect to the triac ground connection. Three different switch configurations must be examined:

a) the seat switch 154 and one of the switches 150, 152 is open (engine stops).

Magneto generated pulses coupled to the safety circuit 100 by the conductor **114*a* are transmitted through the parallel combination of a resistor 174 and a capacitor 176 and charge a capacitor 180 connected to the gate 172. This turns on the triac 170** and provides a low impedance path through the triac for pulses applied to the magneto primary to inhibit generation of spark plug energizing voltages.

b) seat switch 154 open, but both switches 150, 152 closed (engine continues to run).

Magneto generated pulses transmitted by the conductor **114*a* pass through the capacitor 176 and resistor 174, but do not charge the capacitor 180. Instead, these signals pass through the closed safety switches 150, 152 to the parallel combination of the resistor 160, and capacitor 164 which presents a low impedance path to ground for the magneto pulses. The triac 170 remains non-conductive and a sufficient voltage is induced in the magneto secondary to maintain engine operation. The path to ground through the capacitor 176 and resistor 174** presents significantly more impedance than the conducting triac so that the magneto primary is still adequately energized and de-energized by the magneto signals.

c) seat switch 154 closed, one or both of switches 150, 152 open (engine continues to run).

Magneto signals which could charge the capacitor 180 instead pass through the switch 154 to ground. The triac 170 remains non-conductive and therefore a sufficient voltage is induced in the magneto secondary to maintain engine operation. So long as the seat switch is closed, the operator is assumed to be seated on the seat and the engine continues to run regardless of the state of the switches 150, 152.

Figure 3:
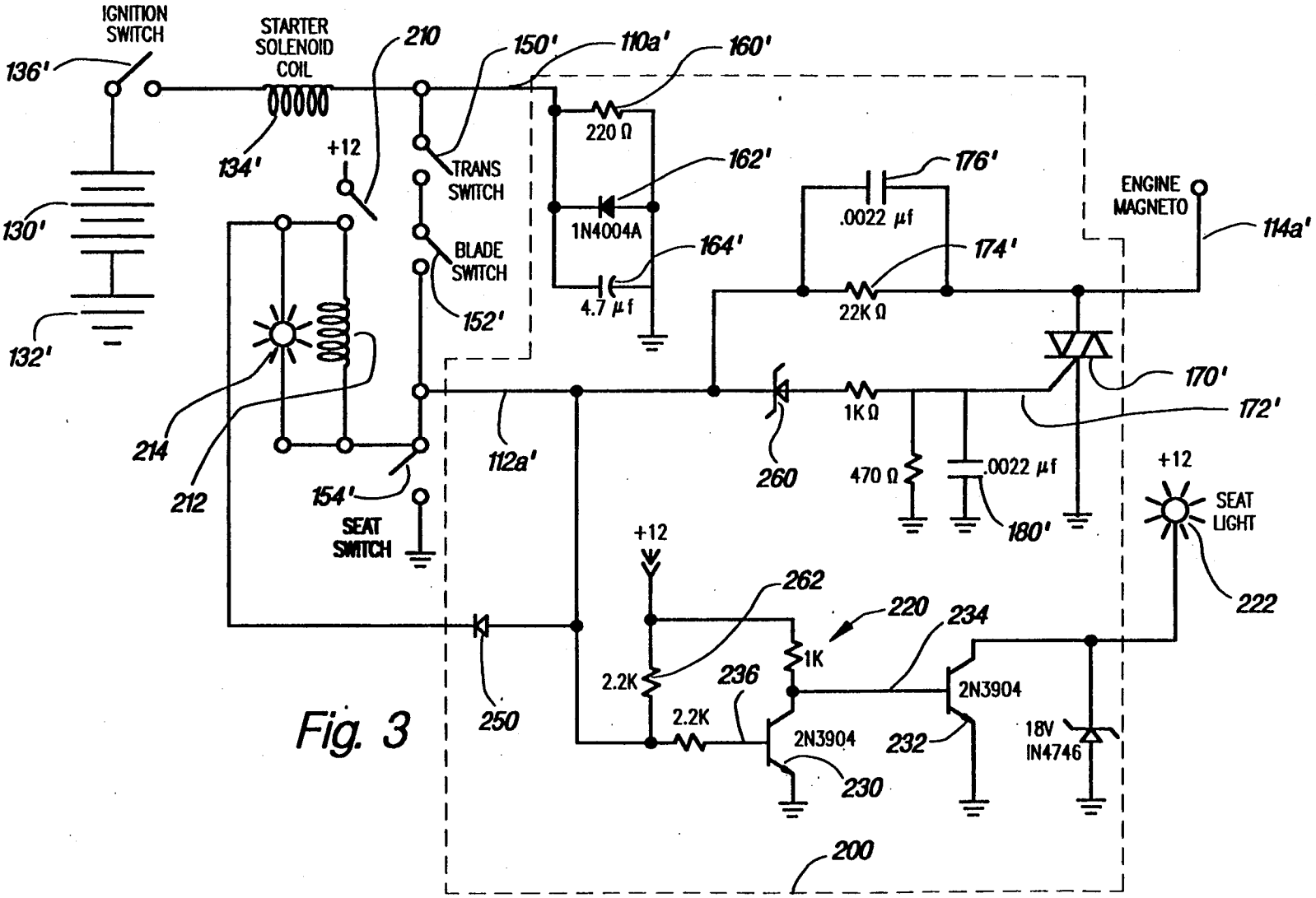
FIG. 3 is an alternate embodiment of a circuit for disabling an engine in response to a sensed condition.

Turning to FIG. 3, this figure shows an alternate design of a safety circuit 200 coupled to an ignition circuit such as an ignition circuit for use with a riding lawn mower. In this figure, certain components of the ignition circuit and the safety circuit 200 function the same as components of FIG. 2. These components are identified with the same reference characters as FIG. 2 but with a differentiating prime (') appended to the reference character. By way of example, the battery 130' of FIG. 3 performs a function similar to the battery 130 of FIG. 2. The circuit 200 is supported within a larger housing (not shown) having eight wires entering the potting material.

The FIG. 3 embodiment of the ignition circuit has a switch contact 210 which operates in parallel with the lawn mower blade safety switch 152'. A solenoid coil 212 is energized if the switch contact 210 is closed and the seat safety switch 154' is also closed. Energization of the solenoid coil 212 causes a clutch to engage, transmitting power to the lawn mower blade. A light bulb 214 electrically coupled in parallel to the solenoid coil 212 is also energized when the switch 210 contact closes.

The circuit 200 also includes a driver circuit 220 for energizing a seat light 222 whenever the seat is occupied. The driver circuit 220 includes two transistors 230, 232 for activating the seat light 222. The transistor 232 is turned on to energize the seat light 222. A base input 234 to this transistor 232 is pulled low when the transistor 230 conducts so that when the transistor 230 conducts, the seat light 222 is extinguished.

The transistor 230 has a base input 236 coupled to a capacitor 238 which normally charges to a level sufficient to turn on the transistor 230. When a discharge path for the capacitor 238 is maintained through the seat switch 154', however, the capacitor 238 discharges and turns off the transistor 230, causing the transistor 232 to turn on and activate the light 222. When the seat switch 154' opens in response to the operator leaving the lawn mower seat, the capacitor 238 charges to turn on the transistor 230, turning off the transistor 232 and extinguishing the light 222.

A diode 250 is coupled between the positive side of the seat switch 154' and the coil 212 for actuating the lawn mower blade clutch. When the switch contact 210 closes, current passes through the coil 212 to actuate the lawn mower blade. When the switch 210 opens in the normal course of lawn mower operation, a back emf is induced in the coil 210 which causes current to flow in the light 214. The diode 250 provides a current dissipation path in parallel with the light 214. Stated in another way, instead of all the current from the coil flowing through the light 214, it flows through the diode 250 and is dissipated in the form of heat in the coil 212, thus avoiding burning out the light 214.

The FIG. 3 circuit also includes a zener diode 260. The zener diode breaks down to conduct high-voltage (approximately 300 volts) pulses from the engine magneto to the gate electrode 172' of the triac 170'. The zener diode 260 does not break down, however, due to the battery voltage applied across a voltage divider of a 2.2K ohm resistor 262 that forms part of the drive circuit 220 and the 220 ohm resistor 160' coupled to ground through the two safety switches 150' and 152'.

Figure 1A:
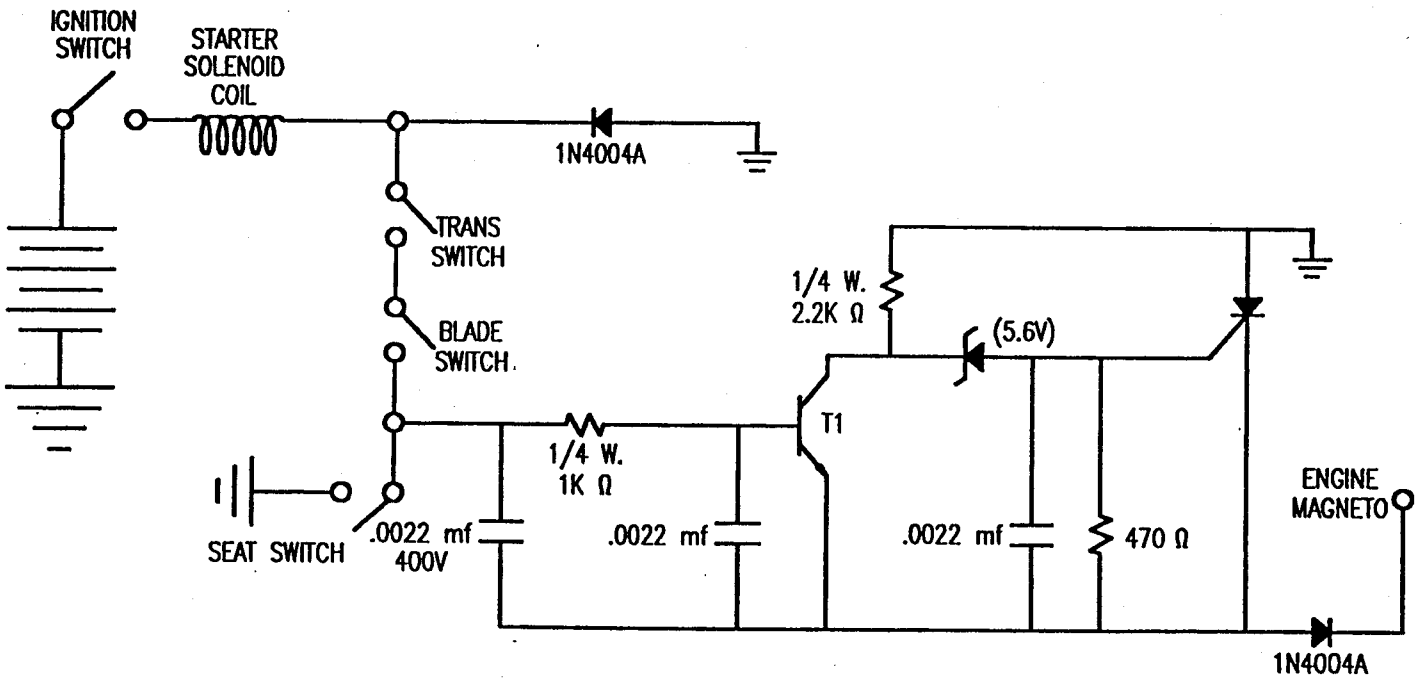
Fig. 1a (Prior Art)
FIG. 1*a* is a prior art circuit sold by the assignee of the invention for disabling a combustion engine.
Figure 1B:
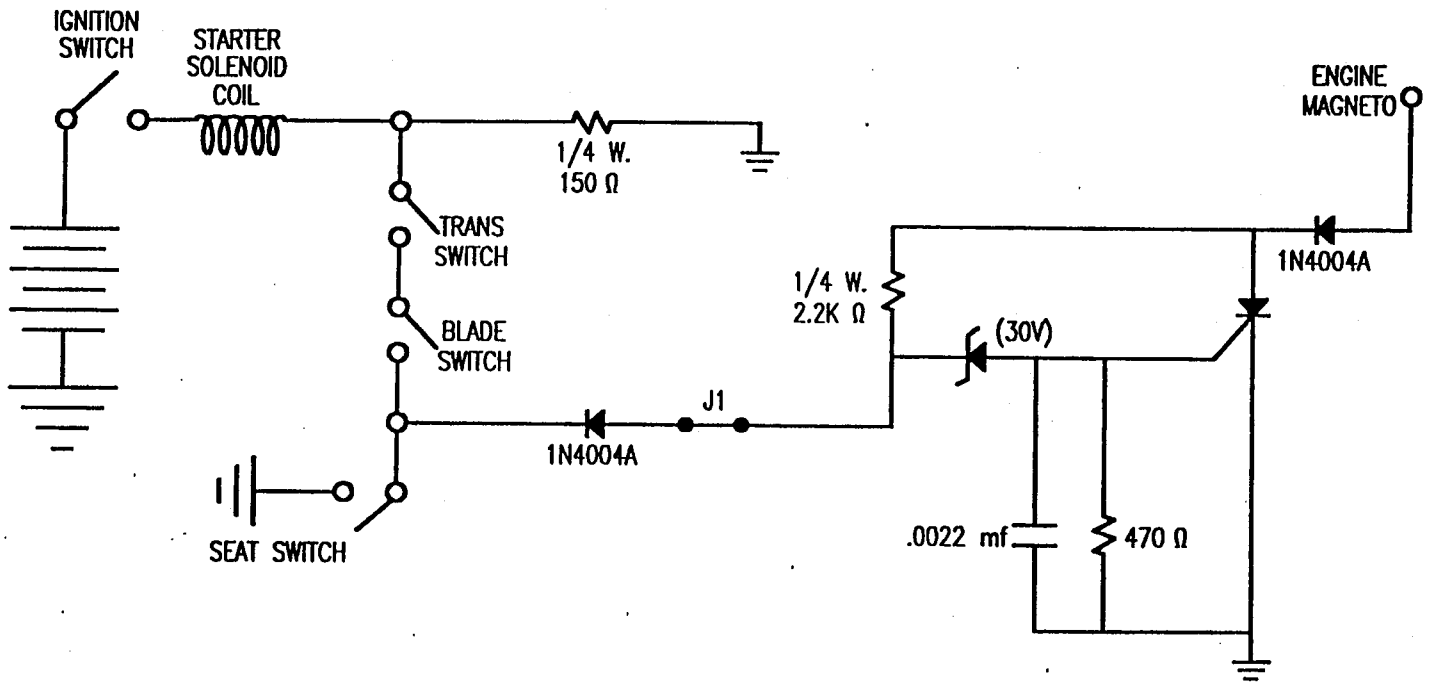
Fig. 1b (Prior Art)
FIG. 1*b* is a prior art circuit sold by the assignee of the invention for disabling a combustion engine.

Experience with the FIG. 1*b* circuit (prior art) has shown that it is susceptible to false sensing of a safe condition. Recall that with this system one safe condition is when the blade switch and transmission switch are closed and pulses from the engine magneto that might turn on the SCR pass to ground through a 150 ohm resistor. If the seat switch is shorted by water, the resistance of the water is approximately 300 ohms. This path to ground may allow the engine to continue to run even though the seat switch is open (a possible unsafe condition).

Returning to FIG. 2, it is seen that magneto pulses transmitted to the circuit 100 by the conductor 114*a* pass through a parallel resistor 174 and capacitor 176. The impedance to these magneto generated pulses is both resistive and capacitive. The combination of the parallel resistor 174 and capacitor 176 and a seat switch 154 shorted by water has a relatively low resistive impedance, but still has a high enough capacitive impedance to allow charging of the capacitor 180 and activation of the triac 170. Experience with the circuit 100 has shown that for some magneto circuits, the resistor 174 can be entirely eliminated and only the capacitor 176 used as a path for magneto pulses that activate the triac 170.

Two embodiments of the invention have been described with a degree of particularity. It is the intent that the invention encompass all alterations and modifications from these embodiments falling within the spirit or scope of the appended claims.

I claim:

1. A safety circuit for inhibiting operation of an engine having a spark plug energized by a magneto coil comprising:

a) a triac coupled to a magneto coil for diverting magneto generated pulses applied to said magneto coil away from said magneto coil and thereby inhibiting engine operation; and b) disabling circuitry for coupling a triac activation voltage to a gate electrode of the triac in response to a sensed condition; said disabling circuitry including a first circuit portion for coupling the magneto generated pulses to the triac gate electrode and rendering said triac conductive to prevent the magneto coil from energizing the spark plug and a second circuit portion for routing magneto generated pulses away from the triac gate electrode to ground, thereby inhibiting triac conduction when a safe operating condition is sensed.

2. The safety circuit of claim 1 wherein the first circuit portion comprises a first capacitor for transmitting magneto generated pulses and a second capacitor coupled to the gate electrode of the triac that charges to the triac activation voltage as the first capacitor transmits the magneto generated pulses.

3. The safety circuit of claim 1 wherein the engine provides motive power to a vehicle having a seat and further wherein the second circuit portion routes magneto generated pulses through a safety switch that is closed when an operator is seated on the seat.

4. The safety circuit of claim 1 wherein the engine provides motive power to a vehicle having a power take-off and further wherein the second circuit portion routes magneto generated pulses through a safety switch that is closed when the portion take-off is disengaged.

5. The safety circuit of claim 1 wherein the engine provides motive power to a vehicle having a transmission and further wherein the second circuit portion routes magneto generated pulses through a safety switch that is closed when the transmission is disengaged.

6. The safety circuit of claim 1 where the second circuit portion of said disabling circuitry comprises a parallel combination of a resistor and a capacitor that is coupled to the gate electrode of the triac through an external safety circuit.

7. The safety circuit of claim 6 additionally comprising means for coupling the parallel combination of the resistor and capacitor to a starter solenoid to inhibit starting of the engine by limiting current through the starter solenoid.

8. A method of sensing an unsafe condition and deactivating an engine having a magneto energized spark plug comprising the steps of:

a) coupling a triac across a magneto coil that generates a spark plug voltage;

b) routing magneto generated pulses to a capacitor coupled to a triac control electrode to charge the capacitor and activate the triac in the event an unsafe condition is sensed; and c) preventing the magneto generated pulses from charging the capacitor during normal engine operation.

9. The method of claim 8 where the preventing step is accomplished by routing the magneto generated pulses away from the capacitor through safety switches which open in the event an unsafe condition is sensed.

10. A safety circuit for inhibiting operation of an engine having a spark plug energized by a magneto coil comprising:

a) a triac coupled to a magneto coil for diverting magneto generated signals applied to said magneto coil away from said magneto coil and thereby inhibiting engine operation; and b) disabling circuitry for coupling a triac activation voltage to a gate electrode of the triac in response to a sensed condition; said disabling circuitry including a first circuit portion for coupling the magneto generated signals to the triac gate electrode and rendering said triac conductive to prevent the magneto coil from energizing the spark plug and a second circuit portion for routing the magneto generated signals away from the triac gate electrode to a reference potential, thereby inhibiting triac condition when a safe operating condition is sensed.

11. A safety circuit for inhibiting operation of an engine having a spark plug energized by a magneto coil comprising:

a) a triac coupled to a magneto coil for diverting magneto generated pulses applied to said magneto coil away from said magneto coil and thereby inhibiting engine operation; and b) disabling circuitry for coupling a triac activation voltage to a gate electrode of the triac in response to a sensed condition; said disabling circuitry including a gate electrode capacitor coupled to the gate electrode of said triac which charges to the triac activation voltage to render the triac conductive to prevent the magneto coil from energizing the spark plug and a capacitor for transmitting magneto generated pulses to the gate electrode capacitor absent closure of a safety switch that provides a low impedance path to ground for the magneto pulses during safe operating conditions.

* * * * *